US006642895B2

(12) United States Patent
Zürcher et al.

(10) Patent No.: US 6,642,895 B2
(45) Date of Patent: Nov. 4, 2003

(54) MULTIFREQUENCY ANTENNA FOR INSTRUMENT WITH SMALL VOLUME

(75) Inventors: Jean-Francois Zürcher, Tavel/Clarens (CH); Anja Skrivervik, Champvent (CH); Olivier Staub, Lausanne (CH)

(73) Assignee: Asulab S.A., Bienne (CH)

( * ) Notice: Subject to any disclaimer, the term of this patent is extended or adjusted under 35 U.S.C. 154(b) by 0 days.

(21) Appl. No.: 10/221,044

(22) PCT Filed: Feb. 23, 2001

(86) PCT No.: PCT/CH01/00119

§ 371 (c)(1),
(2), (4) Date: Sep. 9, 2002

(87) PCT Pub. No.: WO01/69716

PCT Pub. Date: Sep. 20, 2001

(65) Prior Publication Data

US 2003/0030589 A1 Feb. 13, 2003

(30) Foreign Application Priority Data

Mar. 15, 2000 (EP) ..... 00200934

(51) Int. Cl.[7] ..... H01Q 1/12

(52) U.S. Cl. ..... 343/718; 343/702; 343/907; 343/700 MS

(58) Field of Search ..... 343/718, 702, 343/741, 872, 879, 893, 897, 907, 700 MS; 455/77, 90

(56) References Cited

U.S. PATENT DOCUMENTS

| | | | | |
|---|---|---|---|---|
| 2,282,292 A | | 5/1942 | Amy et al. | 250/33 |
| 5,128,686 A | * | 7/1992 | Tan et al. | 343/718 |
| 5,280,645 A | * | 1/1994 | Nguyen et al. | 455/274 |
| 5,450,091 A | * | 9/1995 | Hama | 343/718 |
| 5,659,325 A | * | 8/1997 | Belcher et al. | 343/718 |
| 5,699,319 A | | 12/1997 | Skrivervik | 343/718 |
| 6,304,230 B1 | * | 10/2001 | Panther et al. | 343/867 |

FOREIGN PATENT DOCUMENTS

| | | |
|---|---|---|
| EP | 0 470 797 A2 | 2/1992 |
| EP | 0 871 236 A2 | 10/1998 |
| EP | 0 872 912 A2 | 10/1998 |
| WO | WO 99/03168 | 1/1999 |

* cited by examiner

*Primary Examiner*—Hoang Nguyen
*Assistant Examiner*—Thuy Vinh Tran
(74) *Attorney, Agent, or Firm*—Griffin & Szipl, P.C.

(57) ABSTRACT

The antenna (1) is formed of a first strip element (3) the length (L1) of which is tuned to a high frequency ($f_h$) and at least a second strip (4), following the first (4), of length (L2). The sum of the lengths L1 and L2 results in an antenna whose length L3 is tuned to a low frequency ($f_b$). A resonant circuit (5) including an inductor (6), connected in parallel to a capacitor (7) is located between the first and second strips (3, 4). The values of these components are chosen so that the resonant circuit resonates at the high frequency ($f_h$). When the high frequency is active, the length of the antenna is reduced to that (L1) of the first strip. When the low frequency is active, the length of the antenna extends to the sum (L3) of the lengths of the first and second strips. The inductor (6) is a substantially rectilinear band integrally formed with at least one (3) of said strips and connected to said strip by one (8) of its ends.

11 Claims, 4 Drawing Sheets

Fig. 5
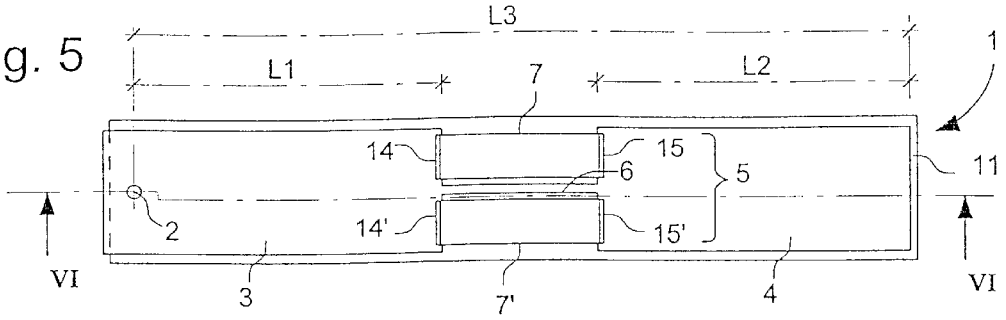
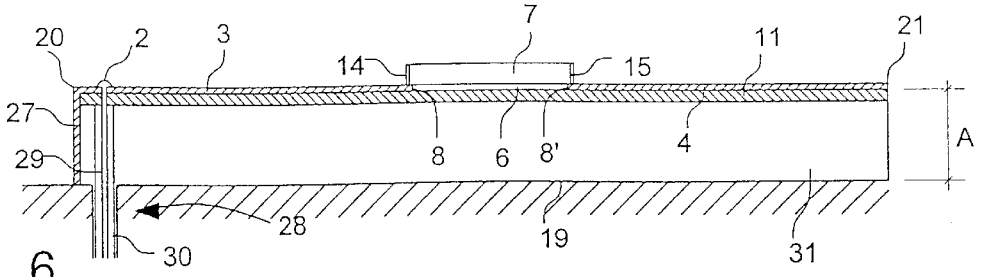
Fig. 6
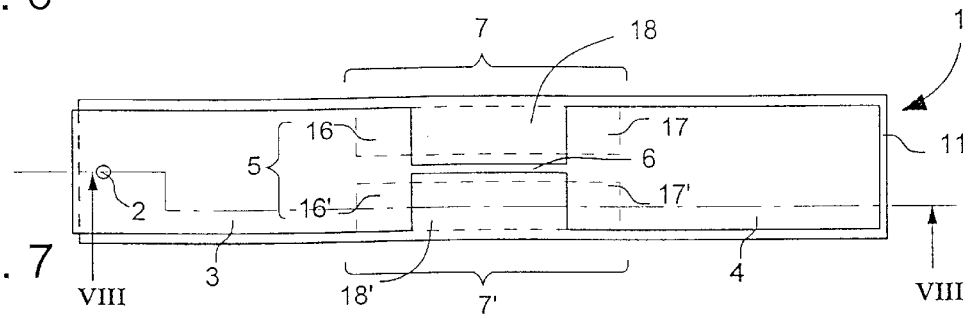
Fig. 7
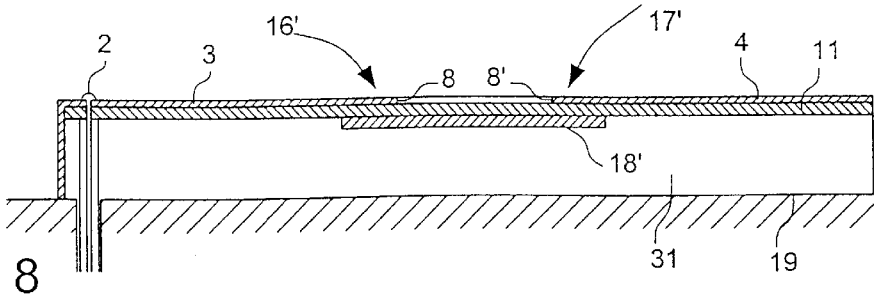
Fig. 8
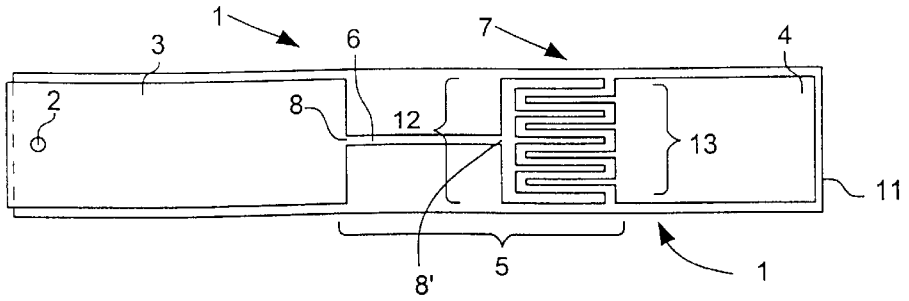
Fig. 9

MULTIFREQUENCY ANTENNA FOR INSTRUMENT WITH SMALL VOLUME

TECHNICAL FIELD

The present invention relates to an antenna of elongated shape for an instrument of small volume, in particular a telephone-watch, capable of receiving and transmitting radiobroadcast messages at at least two frequencies of high and low value, this antenna being formed, from a feed point, of a first radiating element the length of which is tuned to the high frequency and at least a second radiating element, following the first, the length of this second element added to that of the first having a total length tuned to the low frequency, the first and second radiating elements being connected to each other by a resonant circuit whose resonance frequency is chosen to limit the length of the antenna to its first element when the high frequency is active and to use the total length of the antenna when the low frequency is active.

BACKGROUND OF THE INVENTION

An antenna answering the generic definition above is known from the state of the art. It is described, in particular, on page 17-6 of the "ARRL Handbook 1989" and is illustrated in FIG. 1 accompanying the present description. Another example of such an antenna is, for example, disclosed in U.S. Pat. No. 2,282,292. It is a dipole antenna powered by a feeder 25. From a feed point 2, each strand of the antenna includes a first radiating element 3, then a resonant circuit 5, and finally a second radiating element 4. The antenna is intended to be tuned to two different frequencies, for example 28 and 21 MHz. The length L1 of first radiating element 3 is matched to the frequency of 28 MHz (or more exactly to the quarter wavelength of this frequency). The length L2 of second radiating element 4 added to length L1 of the first element leads to a radiating element of length L3 matched to the frequency of 21 MHz (or as above, to the quarter wavelength of this frequency). Resonant circuit 5 is an oscillating circuit including a coil 6 and a capacitor 7 connected in parallel. The values of these components are chosen to resonate at 28 MHz. Since the impedance of the resonant circuit is at a maximum at this frequency, the resonant circuit will act as a "cap" for said frequency and thus limit the length of the strand of first radiating element 3. However, at 21 MHz, the resonant circuit has very low impedance, such that the total length of the strand is used. Thus, via relatively simple means a section L1 or the whole L3 of the antenna can be made to resonate.

At the frequencies considered hereinbefore (the short-wave range) the antenna is made by means of tubes forming radiating elements 3 and 4, these tubes being joined by a sleeve containing resonant circuit 5 made by means of discrete components namely a coil or inductor 6 and a capacitor 7.

The frequencies implemented in these instruments of small volume, for example a mobile telephone or even a telephone watch are much higher than those referred to above. If the principle of matching the antenna to at least two different frequencies can remain the same as that described hereinbefore, the technique used for these short wavelengths will have to be matched to the antenna employed. This antenna has to be able to operate at least with the official frequencies standardised for example by the GSM (Groupe Spécial Mobile) which provides a high frequency $f_h$ equal to 1.9 GHz and a low frequency $f_b$, equal to 900 MHz.

SUMMARY OF THE INVENTION

The idea of the present invention is to propose an antenna capable of being matched to the aforementioned frequencies. For this purpose, in addition to satisfying the definition given in the first paragraph of this description, the antenna is characterised in that the first and second radiating elements each have a conductive strip of substantially rectangular shape and in that the resonant circuit includes the combination of an inductor and a capacitor, said inductor being a narrow substantially rectilinear band formed integrally with at least one of said strips and connected to the strip by one of its ends.

It will be noted that European Patent document No. 0 470 797 discloses an antenna capable of being matched to several frequencies. All the embodiments envisaged in this document nonetheless rely on inductors formed of discrete components which have thus to be bonded via their ends to the various radiating elements of the antenna.

It will also be noted that International Patent document No. WO 99/03168 discloses a compact antenna capable of being matched to at least a low frequency and a high frequency, the antenna being intended, in particular, to be fitted to mobile telephone apparatus. According to an embodiment described with reference to FIG. 1 of this document, the antenna has two radiating elements connected to each other by a resonant circuit which can schematically represented as the parallel arrangement of a capacitor and an inductor. It is proposed to realise this resonant circuit and particularly the inductor in the form of relatively wide printed strip having the shape of a meander. The capacitance value of the resonant circuit is determined here by the stray capacitance present between the "turns" or meanders of the inductor.

One drawback of this solution lies in the fact that the adjustment of the resonant frequency of the resonant circuit is difficult to carry out. Indeed, if one wishes to modify the inductance value of the resonant circuit, the width and/or length of the meander has to be modified. By carrying out such an operation, the stray capacitance value of the resonant circuit is also thereby affected.

The solution of the present invention has the advantage of being able to easily adjust the resonance frequency of the resonant circuit by acting independently on the inductance value or on the value of the capacitor. In particular, the inductor formed of a substantially rectilinear narrow path does not substantially affect the capacitance value of the resonant circuit. Furthermore, a narrow path for the inductance has the advantage of higher inductivity for equal dimension with respect to the solution envisaged in International Patent document No. WO 99/03168.

BRIEF DESCRIPTION OF THE DRAWINGS

The features and advantages of the present invention will now become clear from the following description, made with reference to the annexed drawing, and giving by way of explanatory, but non-limiting example, several advantageous embodiments of the invention, in said drawing:

FIG. 5 shows a fourth embodiment of the antenna according to the invention, FIG. 6 is a cross-section along the line VI—VI visible in FIG. 5, FIG. 7 shows a fifth embodiment of the antenna according to the invention, this embodiment being a variant of the antenna shown in FIG. 5, FIG. 8 is a cross-section along the line VIII—VIII of FIG. 7, FIG. 9 shows a sixth embodiment of the antenna of the invention.

DESCRIPTION OF ILLUSTRATIVE EMBODIMENTS

Figure 1:
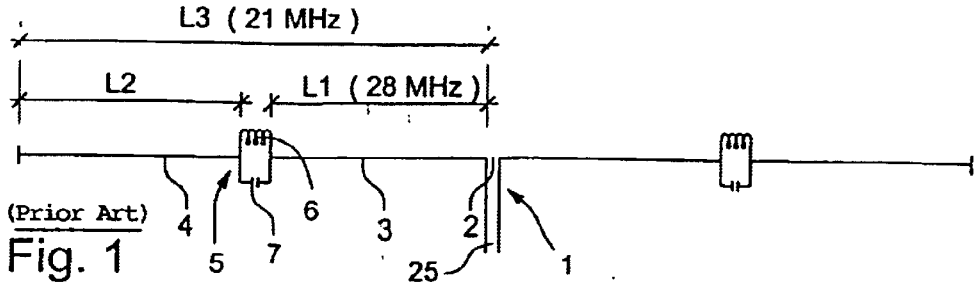
(Prior Art) Fig. 1
FIG. 1 is a diagram explaining a two-frequency antenna made according to the prior art.

As can be seen in FIGS. 2 to 9, the antenna 1 in question has an elongated shape. It is intended for an instrument of small volume, in particular for a telephone housed in a watch, this telephone being capable of receiving and transmitting radiobroadcast messages. Antenna 1 is also capable of working in at least two of high $f_h$ and low $f_b$ frequencies and is formed, from a feed point 2, of a first radiating element 3 whose length L1 is tuned to high frequency $f_h$ and at least a second radiating element 4 which follows the first, length L2 of this second element 4 added to that of the first having a total length L3 tuned to low frequency $f_b$. These same FIGS. 2 to 9 show that the first and second radiating elements 3 and 4 are connected to each other by a resonant circuit 5. The resonance frequency $f_r$ of this resonant circuit 5 is chosen so as to limit the length of antenna 1 to its first radiating element 3 when high frequency $f_h$ is active and to use the total length L3 of the antenna when low frequency $f_b$ is active.

This being so, and as FIGS. 2 to 9 again show, the invention is characterised first of all in that first and second radiating elements 3 and 4 each have a conductive strip of substantially rectangular shape, these strips being placed one after the other. Next, the invention is characterised in that resonant circuit 5 includes the combination of an inductor 6 and a capacitor 7, 7', this inductor 6 being a substantially rectilinear band formed integrally with at least on of said strips and connected to said strip by one of its ends 8, 8'. In this regard, all of FIGS. 2 to 9 show that end 8 of inductor 6 is connected to strip 3 and that inductor 6 is integrally formed with one of the strips, in this case with strip 3.

The basis of the invention having been set forth hereinbefore, various embodiments will now be examined, using the Figures annexed to this description, one after the other.

FIGS. 2 to 8 show that inductor 6 and capacitor 7, 7' are connected in parallel. In these conditions, it will be understood that the value of each of these components will be selected such that the resonant circuit has a resonance frequency $f_r$ substantially equal to the antenna's high operating frequency $f_h$. Indeed, as already mentioned in this the preamble of this description, the impedance of the resonant circuit is at a maximum during resonance, and if the resonant circuit is tuned to high frequency $f_h$, it will represent a cap or a barrier not allowing said high frequency to pass. Since first radiating element 3 includes a length tuned to this high frequency, the antenna will be limited to this first radiating element or first strip 3 if the high frequency is active. Conversely, if it is the low frequency that is active for transmitting or receiving the messages, resonant circuit 5 will have minimum impedance at this frequency, allowing said low frequency to pass. Since the sum of lengths L1 and L2 of strips 3 and 4 is tuned to low frequency $f_b$, the antenna will be matched to this frequency over the whole of its length L3.

Figure 2:
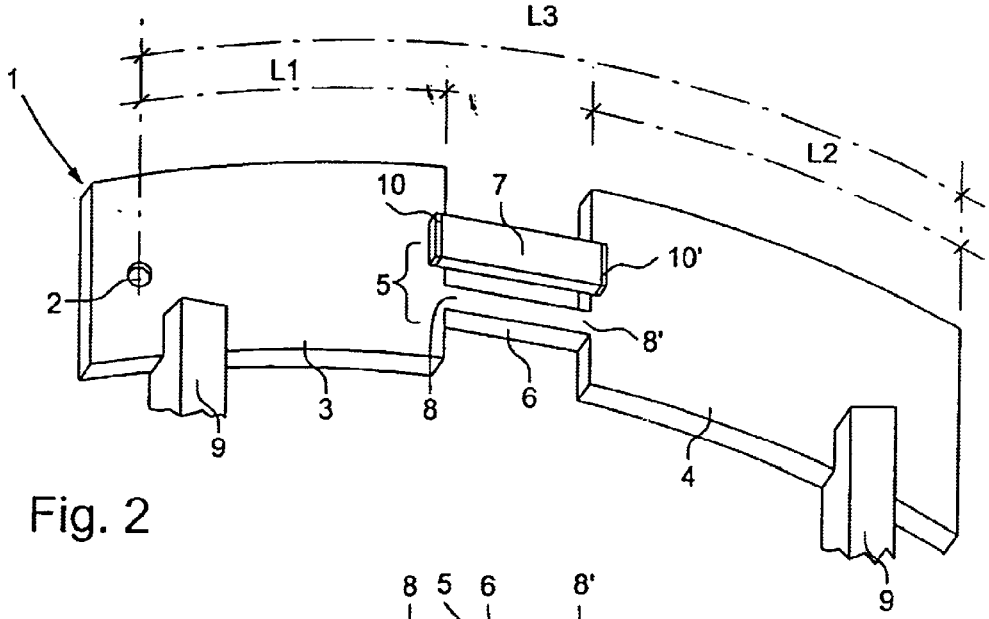
FIG. 2 shows a first embodiment of the antenna according to the invention, this antenna being self-supporting.

FIG. 2 illustrates a first embodiment of the invention. The first and second strips 3 and 4 are self-supporting and thus do not rest on any substrate, although securing means 9 are provided to attach the antenna to the instrument in which it is installed. This naturally assumes that the strips have a certain thickness in order to be able to guarantee the whole assembly a certain mechanical rigidity. In this embodiment, inductor 6 is a substantially rectilinear strip connected via its first end 8 to first strip 3 and via its second end 8' to second strip 4. Here, inductor 6 is formed integrall with its two strips 3 and 4. It will be understood that the assembly of strips 3 and 4 and inductor 6 can be manufactured in a single operation by simple stamping which simplifies manufacture of the antenna enormously. Capacitor 7, however, is a discrete component, executed separately from the strips forming the antenna and having first and second terminals 10 and 10' respectively bonded onto first and second strips 3 and 4. The antenna is fed by a wire (not shown) bonded into a passage 2 made in first strip 3.

With reference to FIG. 2, practical construction values can be given in the case in which $f_b$=900 MHz and $f_h$=1.9 GHz. Length L1 of first strip 3 is equal to 3.4 cm (equivalent to a quarter wavelength of $f_h$). Length L3 (corresponding to a quarter wavelength of $f_h$) is 8.3 cm, hence one deduces that length L2=4.9 cm. It will be observed here that the values given are theoretical given that they are influenced by certain factors, in particular by the width of the strips and the space existing between such strips. Since the position of resonant circuit 5 determines $f_h$, the additional length L2 allows $f_b$ to be adjusted. Thus the two frequencies can easily be adjusted individually. Once the position of resonant circuit 5 has been fixed, $f_h$ can be finally adjusted by regulating the value of capacitor 7.

As regards the values to be given to inductor 6 and capacitor 7, the formula $f_h=\frac{1}{2}\pi\sqrt{LC}$ will be applied. For $f_h$=1.9 MHz, the formula is satisfied if C=0.7 pF and L=10 nHy. Inductor is a narrow band here whose value is approximately 10 nHy per cm. In the example taken here, the space between strips 3 and 4 is thus 1 cm.

Figure 3:
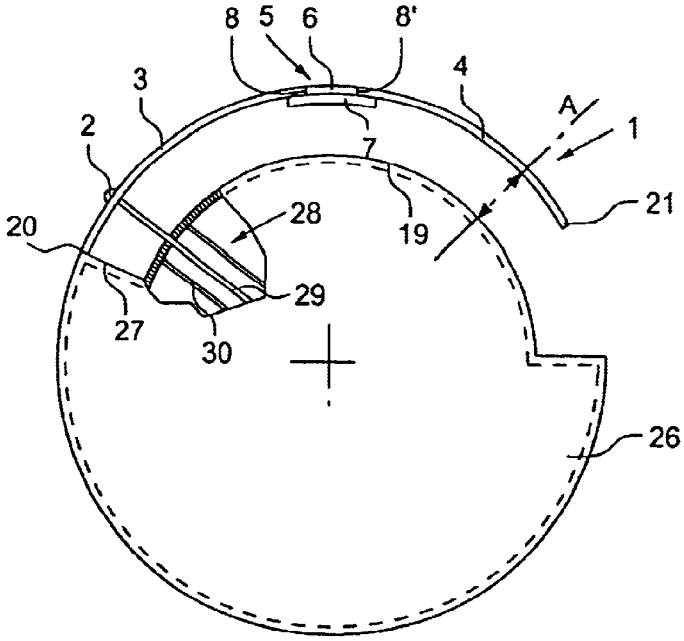
FIG. 3 illustrates a second embodiment of the antenna according to the invention, this antenna being self-supporting and integrated, for example in a watch-telephone.

FIG. 3 illustrates a second embodiment of the invention. One can again see first and second strips, 3 and 4, which are self-supporting and separated by an inductor 5 and a discrete component forming capacitor 7. Here, however, the antenna is wound around a package 26 housing the electronic circuits necessary for the instrument to operate. We will return to this embodiment hereinafter since it includes other useful peculiarities to be noted.

Figure 4:
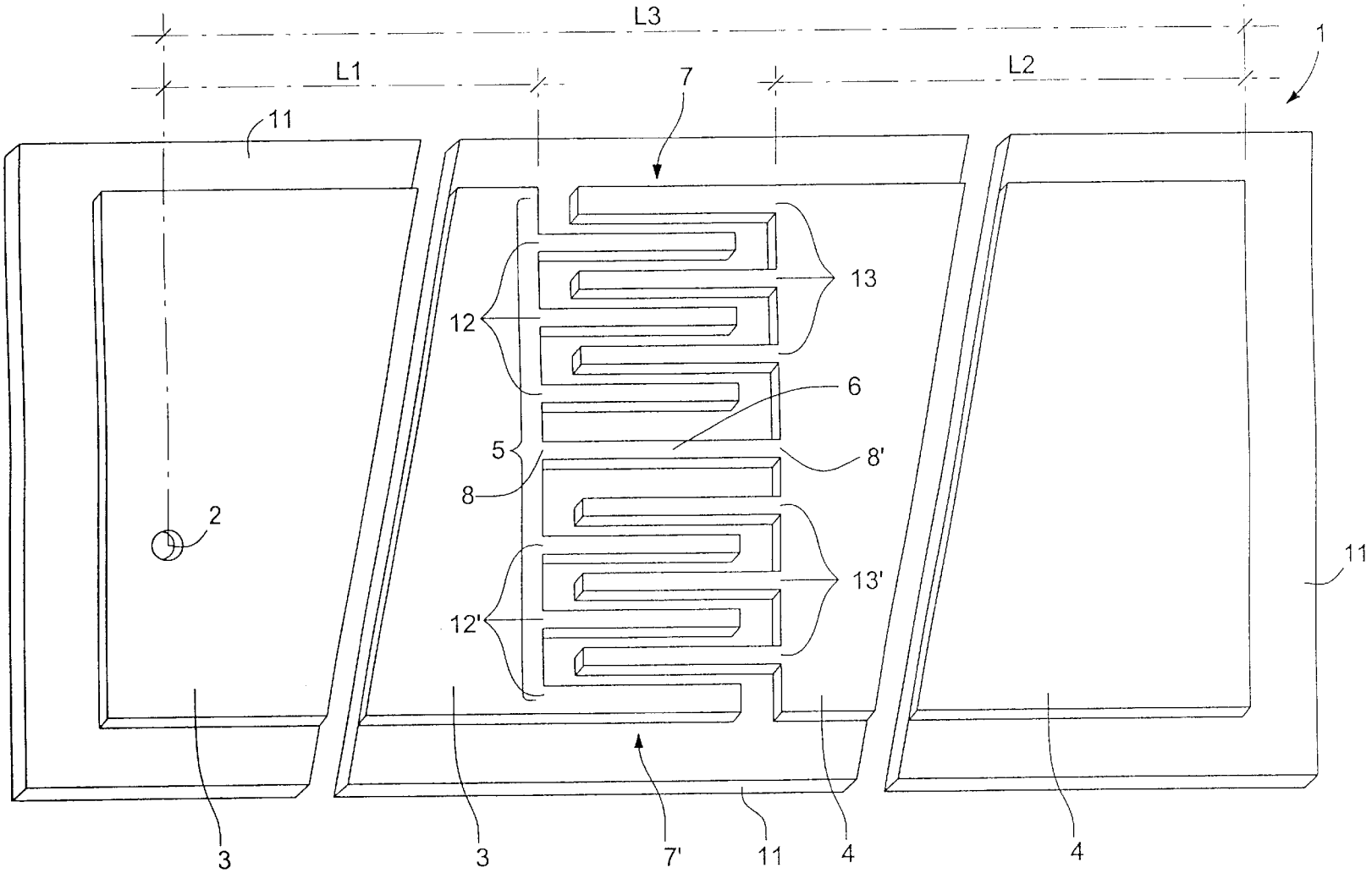
FIG. 4 shows a third embodiment of the antenna according to the invention, this antenna forming an integral part of a printed circuit.

FIG. 4 shows a third embodiment of the invention. With respect to the first and second embodiment, this third embodiment is characterised in that the first and second strips 3 and 4 rest on an insulating substrate 11, for example Kapton (registered trademark) to form a printed circuit.

Inductor 6 is a narrow path printed on substrate 11. It is connected by its first end 8 to first strip 3 and by its second end 8' to second strip 4. It thus forms an integral part of strips 3 and 4. In order to form resonant circuit 5, the capacitor 7, 7' associated with inductor 6 can take various forms.

A first capacitor form is illustrated in FIG. 4. This capacitor is, in reality, two capacitors 7 and 7' located on either side of inductor 6. These two capacitors are connected in parallel and confer symmetry on the resonant circuit assembly. This symmetry is generally desirable and will be preferred to asymmetrical assembly as can be seen in FIG. 2. Capacitor 7, 7' includes a first capacitor plate 12, 12' printed on substrate 11 and connected to first strip 3. It also includes a second capacitor plate 13, 13' also printed on substrate 11 and connected to second strip 4. As shown clearly in FIG. 4, each of these first and second capacitor plates has the shape of a comb whose teeth interlock without touching. The capacitance is created here in the gap existing between the teeth. One may also speak of interdigited capacitance. Moreover, first strip 3 is powered by a conductor (not shown) bonded to feed point 2.

This third embodiment illustrated by FIG. 4 shows how, according to the invention, a two-frequency antenna can be made simply and especially economically. This antenna is in fact entirely made in a single printed circuit, strips 3 and 4, inductor 6 and capacitor 7, 7' being formed by chemical etching in a single operation. This antenna can thus be manufactured at an extremely low cost since no discrete components are necessary to create resonant circuit 5.

A second form of capacitor associated with a printed inductor 6 is shown in FIGS. 5 and 6, FIG. 5 being a plan view of the antenna and FIG. 6 a cross-section along the line VI—VI of FIG. 5. These FIGS. 5 and 6 explain a fourth embodiment of the invention. The capacitor includes the parallel arrangement of two capacitors 7 and 7' located on either side of inductor 6 and each formed of a discrete component having a first terminal 14 and 14' and bonded onto first strip 3 and a second terminal 15 and 15' bonded onto second strip 4. This fourth embodiment has another peculiarity which will be examined hereinafter.

A third form of capacitor associated with a printed inductor is shown in FIGS. 7 and 8, FIG. 7 being a plan view of the antenna and FIG. 8 a cross-section along the line VII—VII of FIG. 7. These FIGS. 7 and 8 explain a fifth embodiment of the invention. The capacitor includes the parallel arrangement of two capacitors 7 and 7' located on either side of inductor 6. Capacitor 7 includes, in turn, the series arrangement of first and second capacitors 16 and 17 each including a common capacitor plate 18 printed under insulating substrate 11, this plate 18 extending partially, on the one hand under first strip 3 to form first capacitor 16 and, on the other hand, under second strip 4 to form second capacitor 17. Capacitor 7' also includes the series arrangement of first and second capacitors 16' and 17' each including a common capacitor plate 18' printed underneath the insulating substrate 11, this capacitor plate 18', extending partially, on the one hand under first strip 3 to form first capacitor 16 and, on the other hand, under second strip 4 to form second capacitor 18'. In this embodiment, it will be understood that substrate 11 acts as a dielectric for each of the aforementioned capacitors. This fifth embodiment is almost as economical as that described with reference to FIG. 4, since all of antenna 1 and resonant circuit 5 can be made by the chemical etching of a double face printed circuit, without adding any discrete components bonded onto the strips.

It was mentioned hereinbefore, with reference to the second (FIG. 3) and fourth (FIG. 6) embodiments, that these embodiments have a peculiarity that should be mentioned now. Indeed, in these particular embodiments, it can be seen that the first and second strips 3 and 4 are arranged at a determined distance A from a ground plane 19, that initial part 20 of first strip 3 is short-circuited with this plane by a bridge 27 and that the final part 21 of second strip 4 is left free. In FIG. 3, ground plane 19 is assimilated to case 26 which is metallic. As FIGS. 3 and 6 show, the antenna is fed by a coaxial cable 28 which includes an inner conductor 29 insulated from ground plane 19 and connected to feed point 2 of first strip 3, this feed point being distant from bridge 27 that short-circuits said first strip 3 and said ground plane 19. The coaxial cable further includes a conductor or shielding 30 connected to ground plane 19. In FIG. 3, the distance A between strips 3 and 4 and ground plane 19 is maintained by the fact that the strips are self-supporting and thus sufficiently rigid to assure this distance. In FIG. 6, distance A is kept by a foam material 31 glued onto substrate 11 and onto ground plane 19.

An antenna like the one shown in FIG. 6, but matched to only one frequency and consequently having only one conductor strip is known as a "planar inverted-F antenna" or PIFA. An detailed analysis of the PIFA structure can be found in the document "Analysis, Design and Measurement of small and Low-Profile Antennas", Artech House, Norwood, Mass., 1992, Ch. 5, pages 161–180, Kazuhiro Hirasawa and Misao Haneishi. The antenna illustrated in FIG. 3 is a variant of the PIFA antenna for matching said antenna to a case forming an integral part of the ground plane, this case including at least a cover, a bottom and a lateral wall facing which is arranged the single strip. This variant was the subject of a European Patent Application No. 99120230.0 filed Oct. 11, 1999 in the name of the same Applicant as for the present invention.

The foregoing was explained to show that the multi-frequency antenna of the present invention can be applied both to a PIFA antenna and to an antenna situated without reference to an immediate ground plane, as is illustrated in FIG. 2 or FIG. 4 for example.

FIG. 9 shows a sixth embodiment of the invention. This embodiment forms part of the second antenna category, referred to hereinbefore, where inductor 6 and capacitor 7 are connected in series. It will be understood that the value of each of these components will be chosen to have a resonance frequency $f_r$ substantially equal to the antenna's low operating frequency $f_b$. In fact, resonant circuit 5 has here minimum impedance at resonance. As a result when low frequency $f_b$ is active, resonant circuit 5 does not offer any resistance to this frequency. The length of strip 4 is thus added to the length of strip 3 and the antenna is matched to low frequency $f_b$. Conversely, if it is high frequency $f_h$ that is active, only strip 3, matched to $f_h$, will be used since at the high frequency, the resonant circuit has very high impedance preventing the propagation of $f_h$ beyond first strip 3.

FIG. 9 shows a practical antenna construction example with a resonant circuit 5 including the series arrangement of an inductor 6 and a capacitor 7. First and second strips 3 and 4 rest on an insulating substrate 11 to form a printed circuit. Inductor 6 is a narrow path printed on the substrate and connected by its first end 8 to first strip 3. The second end 8' of inductor 6 is connected to a first capacitor plate 12 of a capacitor 7, whereas a second capacitor plate 13 of the same capacitor 7 is connected to second strip 4. It can be seen that first and second capacitor plates 12 and 13 have the shape of a comb whose teeth interlock without touching. The same comment can be made here as that expressed with reference to FIG. 4. In fact, strips 3 and 4 and resonant circuit 5 are printed on a substrate 11 without the addition of any external components. This is thus a very inexpensive antenna made simply by chemically etching a printed circuit.

Figure 10:
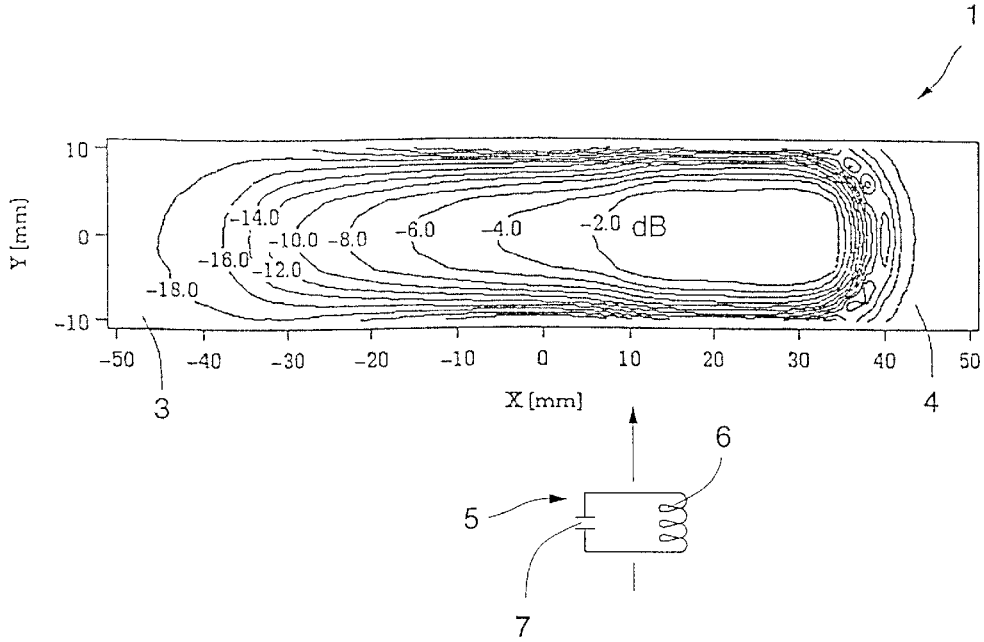
FIG. 10 is a plan view of the antenna of the invention, in which the level curves of the electric component of the electromagnetic field are shown when the antenna is working at low frequency $f_b$.
Figure 11:
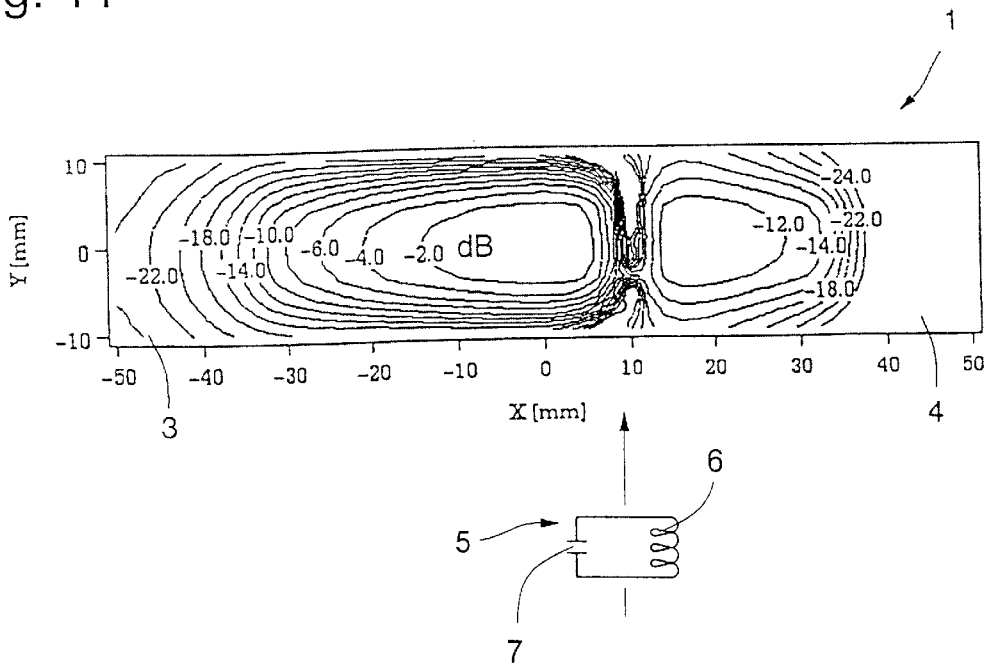
FIG. 11 is a plan view of the antenna of the invention, in which the level curves of the electric component of the electromagnetic field are shown when the antenna is working at high frequency $f_h$.

FIGS. 10 and 11 are plan views of the antenna according to the invention drawn over a length X of ±50 mm and over a width Y of ±10 mm. These Figures show the level curves, expressed in dB, of the electric component Ez of the electromagnetic field perpendicular to the plane of the antenna and measured in proximity to such plane. Resonant circuit 5 is an oscillating circuit including the parallel arrangement of an inductor 6 and a capacitor 7 as described hereinbefore. It resonates at high frequency $f_h$. The antenna is formed of first strip 3 and second strip 4, said strips being separated by resonant circuit 5 placed at x=+10 mm. FIG. 10 shows the behaviour of antenna 1 when low frequency $f_b$ is active. The antenna is used over a large part of its length and ignores the presence of the resonant circuit whose impedance is very low. FIG. 11 shows the behaviour of antenna 1 when high frequency $f_h$ is used. The antenna is used over its left part, which is the location of first strip 3. Resonant circuit 5 blocks the passage of the signal to the right where the signal appears very weakly (from −12 to −24 dB).

All of the antenna embodiments described hereinbefore are adapted to a two-frequency antenna. It is clear that the invention is not limited to the use of two frequencies. For example if a third additional frequency, even lower than that designated hereinbefore by $f_b$, has to be radiated by the antenna, it will be understood that one need only arrange a third strip, after second strip 4 and a second resonant circuit between the second and third strip. The length of this third strip will be selected so that, when added to the length of the first two strips, the total length of the antenna will be tuned to the new lowest frequency. In this case, the resonance frequency of the second resonant circuit will be chosen to be $f_b$.

What is claimed is:

1. Antenna of elongated shape for an instrument of small volume, in particular a telephone-watch, capable of receiving and transmitting radiobroadcast message at at least two frequencies of high and low values, this antenna being formed, from a supply point of a first radiating element the length of which is tuned to the high frequency and at least a second radiating element, following the first, the length of this second element added to that of the first having a total length tuned to the low frequency, the first and second radiating elements being connected to each other by a resonant circuit whose resonance frequency is chosen to limit the length of the antenna to its first element when the high frequency is active and to use the total length of the antenna when the low frequency is active, wherein the first and second radiating elements each have a conductive strip of substantially rectangular shape and wherein the resonant circuit includes the combination of an inductor and a capacitor, said inductor being a substantially rectilinear narrow band integrally formed with at least one of said strips and connected to said strip by one of its ends.

2. Antenna according to claim 1, wherein the inductor and the capacitor are connected in parallel, the value of each of these components being selected so as to have a resonance frequency substantially equal to the antenna's high operating frequency.

3. Antenna according to claim 2, wherein the first and second strips are self-supporting and held in the instrument by securing means, wherein the inductor is connected by its first end to the first strip and by its second end to the second strip and wherein the capacitor is a discrete component having first and second terminals respectively bonded onto the first and second strips.

4. Antenna according to claim 3, wherein the first and second strips are arranged at a determined distance from a ground plane, the initial part of the first strip being short-circuited with this ground plane and the final part of the second strip being left free.

5. Antenna according to claim 2, wherein the first and second strips rest on an insulating substrate to form a printed path on said insulating substrate and connected by its first end to the first strip and by its second end to the second strip.

6. Antenna according to claim 5, wherein the capacitor includes a first capacitor plate printed on the insulating substrate and connected to the first strip and a second capacitor plate printed on the insulating substrate and connected to the second strip each of said first and second capacitor plates having the shape of a comb whose teeth interlock without touching.

7. Antenna according to claim 5, wherein the capacitor is a discrete component having first and second terminals respectively bonded onto the first and second strips.

8. Antenna according to claim 5, wherein the capacitor includes the series arrangement of first and second capacitors each including a common capacitor plate printed under the insulating substrate, this common capacitor plate extending partially, on the one hand, under the first strip to form the first capacitor and, on the other hand, under the second strip to form the second capacitor, said insulating substrate acting as a dielectric for each of said first and second capacitors.

9. Antenna according to claim 5, wherein the first and second strips are arranged at a determined distance from a ground plane, the initial part of the first strip being short-circuited with this ground plane and the final part of the second strip being left free.

10. Antenna according to claim 1, wherein the inductor and the capacitor are connected in series, the value of each of these components being chosen to have a resonance frequency substantially equal to the antenna's low operating frequency.

11. Antenna of elongated shape for an instrument of small volume, in particular a telephone-watch, capable of receiving and transmitting radiobroadcast message at at least two frequencies of high and low values, this antenna being formed, from a supply point of a first radiating element the length of which is tuned to the high frequency and at least a second radiating element, following the first, the length of this second element added to that of the first having a total length tuned to the low frequency, the first and second radiating elements being connected to each other by a resonant circuit whose resonance frequency is chosen to limit the length of the antenna to its first element when the high frequency is active and to use the total length of the antenna when the low frequency is active, wherein the first and second radiating elements each have a conductive strip of substantially rectangular shape and wherein the resonant circuit includes the combination of an inductor and a capacitor, said inductor being a substantially rectilinear narrow band integrally formed with at least one of said strips and connected to said strip by one of its ends, wherein the inductor and the capacitor are connected in series, the value of each of these components being chosen to have a resonance frequency substantially equal to the antenna's low operating frequency, and wherein the first and second strips rest on an insulating substrate to form a printed circuit and wherein the inductor is a narrow printed patch on said insulating substrate and connected by a first end to the first strip and by a second end to a first capacitor plate of a capacitor whose second capacitor plate is connected to the second strip, each of said first and second capacitor plates being printed on the insulating substrate, said first and second capacitor plates having the shape of a comb whose teeth interlock without touching.

* * * * *